US010046455B2

(12) United States Patent
Johnson

(10) Patent No.: US 10,046,455 B2
(45) Date of Patent: Aug. 14, 2018

(54) MULTI-POSITION TOOL BOX SYSTEM AND METHOD

(71) Applicant: Brooks Johnson, Blaine, MN (US)

(72) Inventor: Brooks Johnson, Blaine, MN (US)

( * ) Notice: Subject to any disclaimer, the term of this patent is extended or adjusted under 35 U.S.C. 154(b) by 0 days.

(21) Appl. No.: 15/484,916

(22) Filed: Apr. 11, 2017

(65) Prior Publication Data

US 2017/0217012 A1 Aug. 3, 2017

Related U.S. Application Data

(63) Continuation of application No. 13/572,450, filed on Aug. 10, 2012, now Pat. No. 9,617,035.

(60) Provisional application No. 61/522,132, filed on Aug. 10, 2011.

(51) Int. Cl.

| | |
|---|---|
| ***B65D 21/02*** | (2006.01) |
| ***B25H 3/02*** | (2006.01) |
| ***B65D 25/30*** | (2006.01) |
| ***B65D 25/24*** | (2006.01) |
| ***B65D 55/02*** | (2006.01) |
| ***B65D 43/02*** | (2006.01) |
| ***B65B 5/00*** | (2006.01) |
| ***B44D 3/14*** | (2006.01) |
| ***A47C 12/00*** | (2006.01) |

(52) U.S. Cl.

CPC ..... *B25H 3/023* (2013.01); *A47C 12/00* (2013.01); *B44D 3/14* (2013.01); *B65B 5/00* (2013.01); *B65D 21/0209* (2013.01); *B65D 25/24* (2013.01); *B65D 25/30* (2013.01); *B65D 43/02* (2013.01); *B65D 55/02* (2013.01)

(58) Field of Classification Search

CPC ..... B65D 21/02; B25H 3/02

USPC ..... 206/373, 509, 741, 743, 747, 762; 220/23.83, 23.4

See application file for complete search history.

(56) References Cited

U.S. PATENT DOCUMENTS

| | | | | |
|---|---|---|---|---|
| 3,862,689 | A | 1/1975 | Taub | |
| 5,797,508 | A | 8/1998 | Loftus et al. | |
| 5,799,787 | A | 9/1998 | Talbot | |
| 7,686,180 | B1 | 3/2010 | MacDonald et al. | |
| 8,695,795 | B1 | 4/2014 | Huber | |
| 8,991,599 | B2 * | 3/2015 | Wilson | B25H 3/026 108/145 |
| 2010/0314271 | A1 * | 12/2010 | Baruch | A47B 43/00 206/349 |

* cited by examiner

*Primary Examiner* — Anthony Stashick
*Assistant Examiner* — Raven Collins
(74) *Attorney, Agent, or Firm* — Billion & Armitage; Richard E. Billion

(57) ABSTRACT

A multi-position storage system including a first housing, and a second housing. The second housing is connected to the first housing. The second housing is capable of being moved from a first position with respect to the first housing to a second position with respect to the first housing.

17 Claims, 8 Drawing Sheets

MULTI-POSITION TOOL BOX SYSTEM AND METHOD

RELATED APPLICATIONS

This application claims the benefit under 35 U.S.C. § 120 of prior U.S. patent application Ser. No. 13/572,450, filed Aug. 10, 2012, which is incorporated herein by reference, and which in turn claims the benefit under 35 U.S.C. § 119(e) of prior U.S. Provisional Patent Application No. 61/522,132, filed Aug. 10, 2011, which is also incorporated herein by reference

TECHNICAL FIELD

Various embodiments described herein relate to a multi-position storage system or multi-position tool box system and a method for using the same.

BACKGROUND

Tool boxes and storage containers that sit on the floor generally serve one purpose. They hold what needs to be stored and serve no other purpose. If sufficiently light, many times, users generally pick up the tool box or storage box and place it on a shelf or short table where they can look through it more easily. They lift the storage box or tool box so that it is placed at a more comfortable height to search for the stored item needed. Basically, the user is placing the box in a more ergonomic position where he or she does not have to bend over or kneel down to search the contents of the box. When the box is too heavy, the user has to bend over the box in a less comfortable position to search the contents. In the alternative, the user will kneel or sit beside the box to search the contents. This may be more comfortable than bending over the box, but still less ergonomic than if the box could be placed at a proper height to gain access to the contents.

In addition, tool boxes or storage boxes are typically single purpose items. The primary purpose is the only purpose. Namely, they store items, such as tools and have no other purpose.

DETAILED DESCRIPTION

Figure 1:
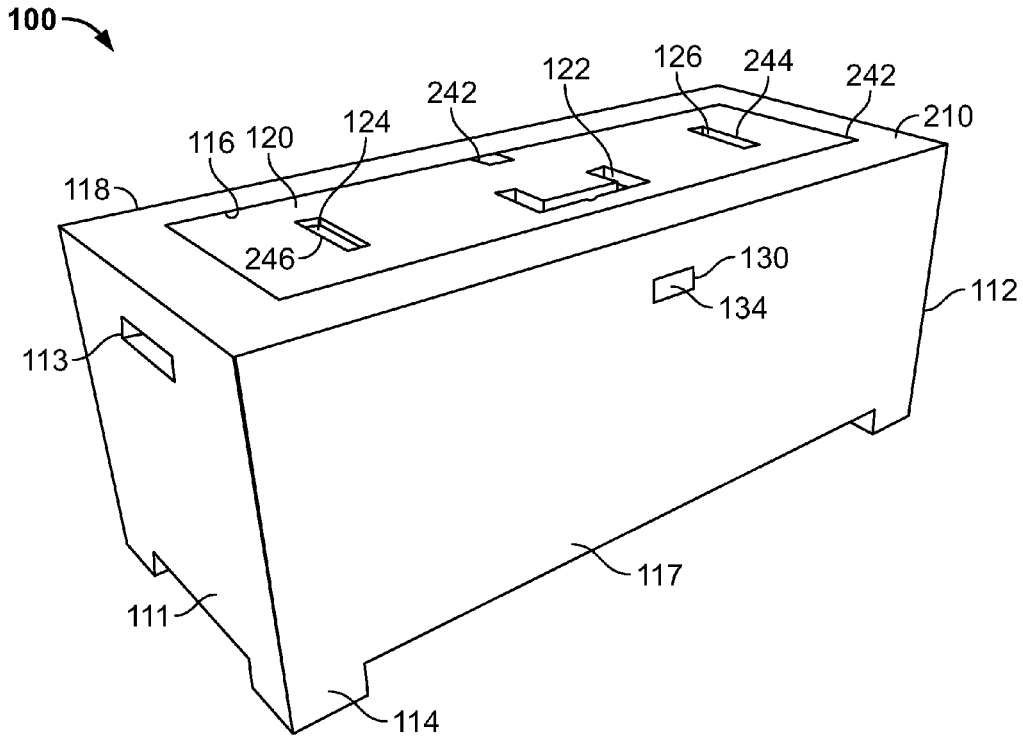
FIG. 1 is a perspective view of a multi-position tool box and storage system in a closed position, according to an example embodiment.
Figure 2:
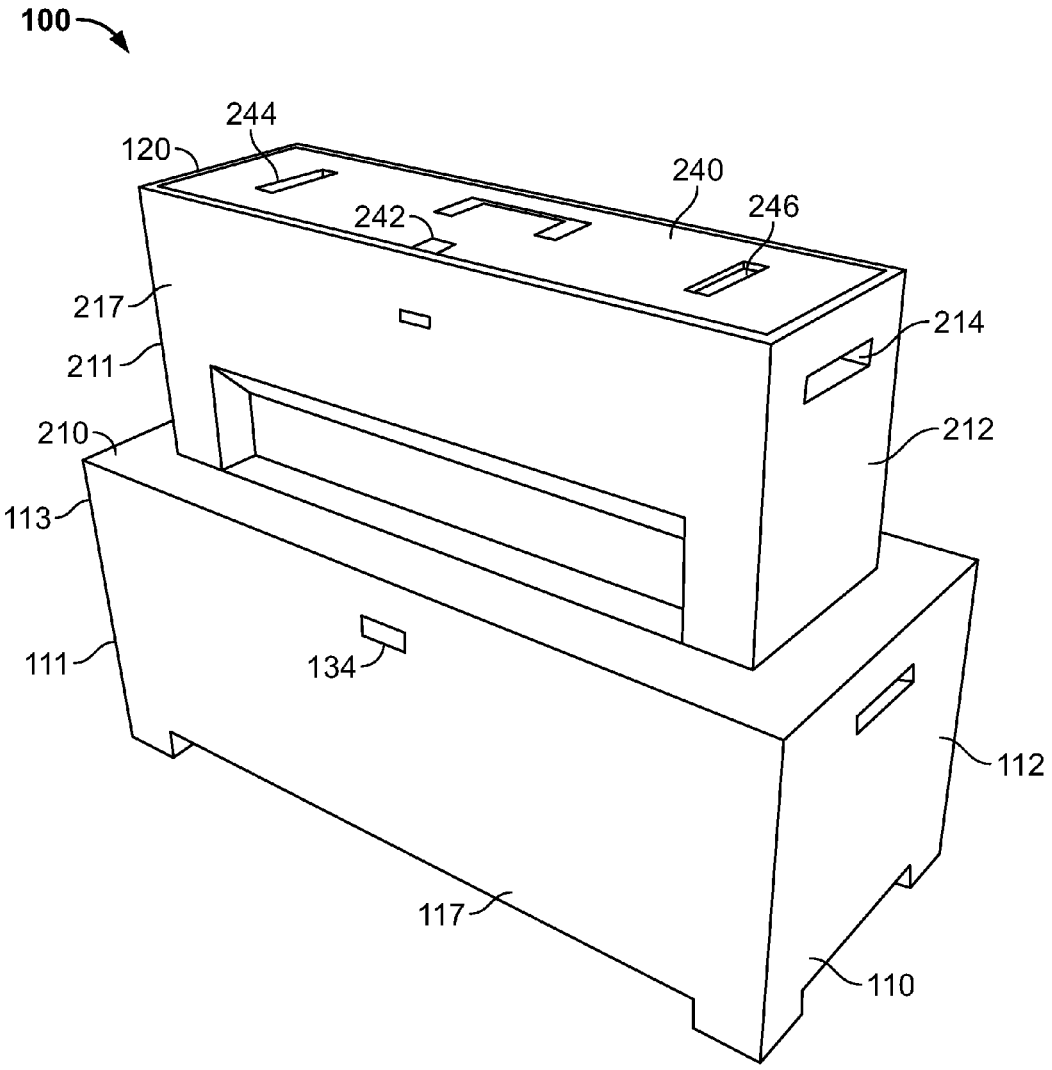
FIG. 2 is a perspective view of a multi-position tool box and storage system in an open position, according to an example embodiment.

FIG. 1 is a perspective view of a multi-position storage system 100 in a closed position, according to an example embodiment. FIG. 2 is a perspective view of the multi-position tool box and storage system 100 in an open position, according to an example embodiment. The multi-position tool box and storage system 100 will now be described in more detail while referring to both FIGS. 1 and 2. The multi-position storage tool box and system 100 includes a base 110 and a housing 120 which fits within the base 110. The base 110 include a first end 111 and a second end 112. The base 110 includes a handle 113 on the first end, and a similar handle (not shown) on the second end 112. The base also includes legs, such as leg 114. The housing also includes a first side 117 and a second side 118. The first side 117 includes a side panel. The base 110 also includes an opening 116 into which the housing 120 fits. The housing 120 includes a container for containing items, such as tools. The housing 120 can be plain or can be provided with special features for different applications. The housing 120 is attached to the base with hardware that provides mechanical assistance as the housing 120 is moved from a closed position (shown in FIG. 1) to an open or deployed position (shown in FIG. 2). The housing 120 include a centrally located handle 122 and two side handles 124 and 126. The central handle is pivotally attached and includes a separate handle that can be used to lift the housing 120 and the base 110 or can be used to move the housing 120 with respect base 110. The two side handles 124, 126 include built in slots or hand holds. The two side handles 124, 126 can be used to lift the housing 120 out of the base 110 or can be used to lift the base 110 and the housing 120.

The base includes a locking mechanism 130 that includes at least a first locking portion 132 and a second locking portion 134. The first locking portion 132 and the second locking portion 134 engage an opening in the housing 120 to keep it in the closed position so that the central handle 122 or the side handles 124, 126 can be used to lift both the base 110 and the housing 120. The locking mechanism 132, 134, when engaged with the housing 120 will substantially prevent relative motion between the base 110 and the housing 120. The locking mechanism 130 is sized so that it can withstand a large load. The housing 120 and base 110 are built so that they can withstand the weight of a human being. Generally, a factor of safety is provided so that the locking mechanism will hold even if someone is beyond the weight limits specified by the product. The locking mechanism 130 can be any sort of locking mechanism. For example, locking member 132, 134 can be a simple block which is moved into a similarly shaped opening in the housing 120. Such a block or set of blocks would prevent the movement of the housing 120 with respect to the base 110.

FIG. 2 shows the housing 120 elevated with respect to the housing 110. The locking mechanism 130 is disengaged to move the housing 120 with respect to the housing 110. The housing 120 is moved with respect to the housing 110 to place the housing 120 in an elevated position with respect to the housing 110. The locking mechanism 130 is re-engaged to again lock the housing 120 into a fixed position with respect to the base 110. In this case, the housing 120 is elevated with respect to the base 110.

The housing 110 includes framing and structural support for the pop-up box 100. The housing 120 slides up and down with respect to the housing 110 and can be locked into different heights when extended using a locking mechanism 130. When housing 120 is extended, a user can stand on top of the housing 120. As seen in FIG. 2, when housing 120 is extended, there is an area around the outer top section of housing 110 that forms a step 210 around the lower level of the housing 120 and which is used to access the top of the housing 120. The top of the housing 120 is the top step.

The side 117 includes a side panel that can be removed or opened to provide the user with more room to place their feet when stepping from floor to the step surface 210 of the housing 110. The housing 120 includes ends 211 and 212. A handle 214 is associated with the end 212 of the housing 120. A similar handle is also located on the end 211 (not shown). The handles, such as handle 214, link to a mechanism. The mechanism engages or disengages a pin system 150, which is further detailed in FIG. 8. The pin system locks the housing 120 in an extended position with respect to the housing 110 when in a first position. The pin system can lock the housing 120 into one of several extended positions. The pin system 150 will release the housing 120 when the handles, such as handle 214, is in a second position. When released, the housing 120 will drop down into housing 110. When housing 120 is nested within or inside of housing 110, the top of housing 120 will be substantially flush (shown in FIG. 1) with the top of the housing 110. The pin system will lock housing 120 to housing 110 together.

Housing 120 includes, in one embodiment, a storage compartment 230. The storage compartment 230 is inside of housing 120. The top of the housing 120 includes a lid 240, which will open and close, to selectively expose the storage compartment 230. The lid 240 of housing 120 includes a lock 242, which will be used to keep the lid 240 closed or will allow the lid 240 to open. The lock 242 is used to lock the lid 240 of housing 120 into a side wall 217 of the housing 120. The lid 240 pivots with respect to the housing 120.

The second housing 120 is raised with respect to the first housing 110 by pulling up or applying force to handles 244, 246. Pulling up on handle 244, 246 disengages pin system 150, allowing the second housing 120 to move into an extended position. When the housing 120 is at the proper or desired height, pin system 150 will engage, locking the housing 120 into an extended position. Handle 248 of second housing 120 and handles 160 associated with end 112 and a similar handle associated with end 113 are used for carrying pop-up box unit 100. Lock 242 keeps the lid 240 of housing 120 locked in a closed or shut position.

Figure 3:
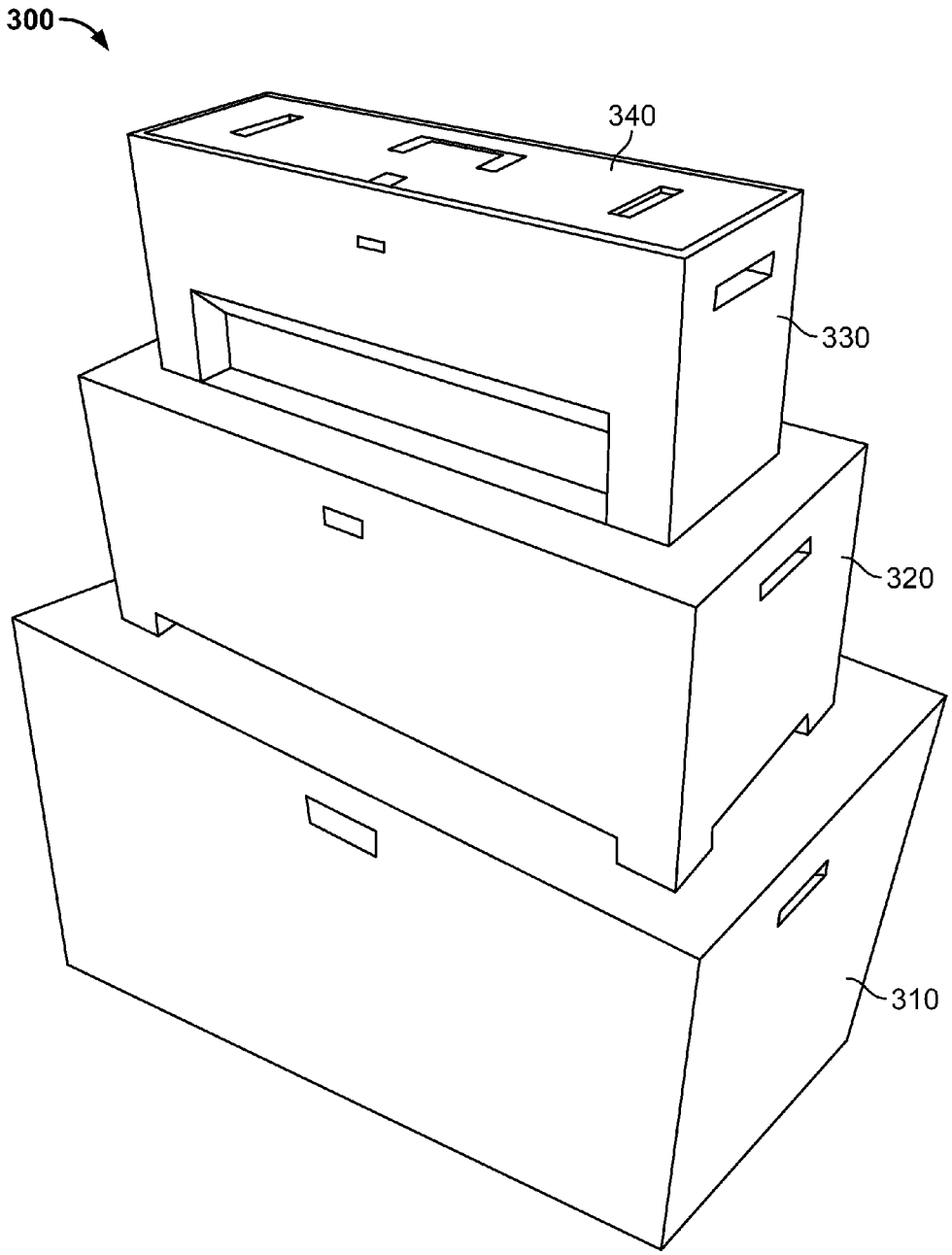
FIG. 3 is a perspective view showing another multi-position storage system, according to another embodiment.

FIGS. 1 and 2 show a multi-position tool box and storage system 100 having a first housing 110 and a second housing 120. The multi-position storage system or tool box can include any number of housings that move with respect to one another. FIG. 3 is a perspective view of a multi-position tool box and storage system 300 that has a first housing 310, a second housing 320 and a third housing 330. The hardware between the housing is substantially similar to the hardware between the first housing 110 and the second housing 120. The end result is that the first housing and second housing form a set of steps to a top surface 340 at the top of the third housing 330.

In one example embodiment, the distance between the various housings is varied. In particular, in one example embodiment the height of the housings 110. 120 or the height 310, 320, 330 are lessened to make shallower steps for smaller people that naturally do not have the ability to climb larger steps having a larger distance between steps.

In one example embodiment, the lid 240 of the second housing 120 opens to reveal a tool box. The tool box can be provided with removable trays to allow various layers of tools to be stored. The tool box embodiment can also be outfitted with slide out trays for holding tools. The slide out trays can hold general tools or specialized tools. The trays can be provided with cut outs to hold specialized tools. There can be one or a plurality of trays for holding tools.

Figure 8:
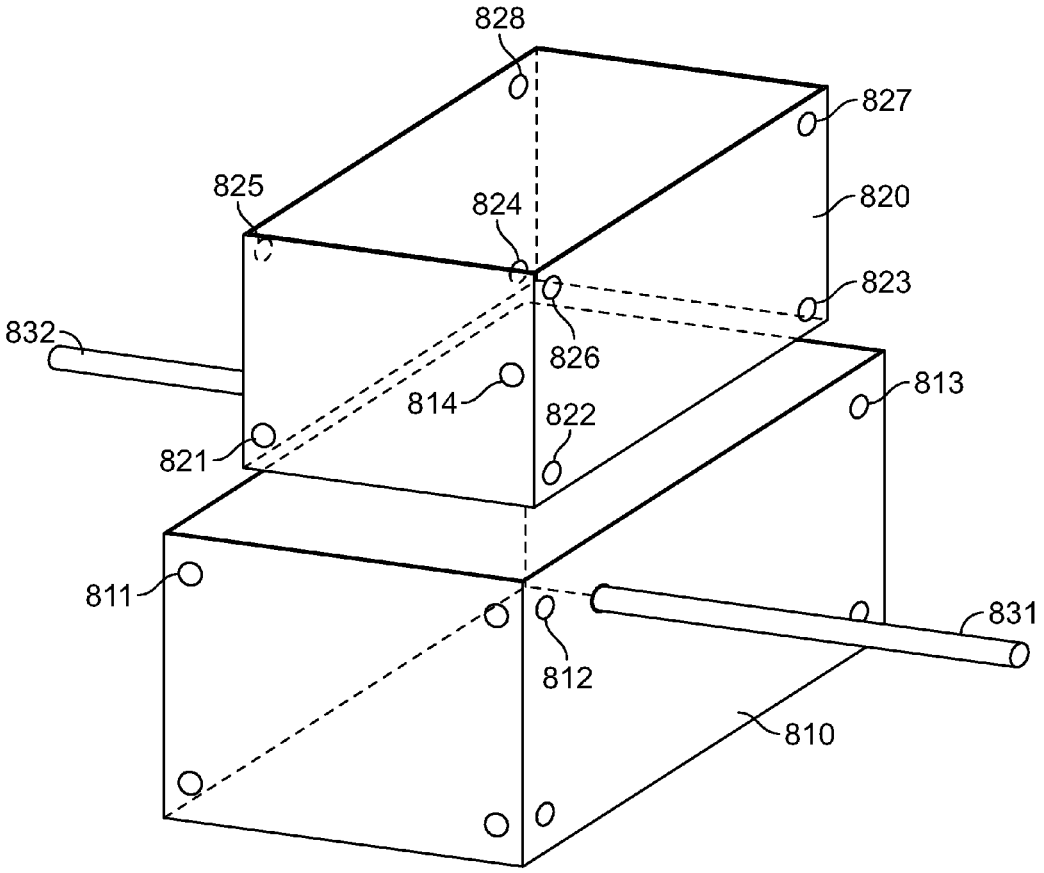
FIG. 8 a multi-position tool box and storage system for use as a cooler or a beverage dispenser, according to an example embodiment.

FIG. 8 details a pin system 150 for a multi-position tool box and storage system, according to an example embodiment. A first housing 810 is provided with a set of openings 811, 812, 813, 814 sized to receive pins 831 and 832. A second housing 820 also has openings 821, 822, 823, 824 sized to receive the pins 831 and 832 when the second housing 820 is in a first position with respect to the first housing 810. The second housing also has openings 825, 826, 827, 828 sized to receive the pins 831 and 832 when the second housing 820 is in a second position with respect to the first housing 810. When the second housing 820 is in a first position with respect to the second housing 810, pin 831 passes through openings 811 and 812 in the first housing 810 and passes through openings 821 and 822 in the second housing 820. The pin 832 passes through openings 813 and 814 in the first housing 810 and passes through openings 823 and 824 in the second housing 820.

When the second housing 820 is in a second position with respect to the second housing 810, pin 831 passes through openings 811 and 812 in the first housing 810 and passes through openings 825 and 826 in the second housing 820. The pin 832 passes through openings 813 and 814 in the first housing 810 and passes through openings 827 and 828 in the second housing 820. The openings in the second housing 820 are in two groups. Extra groups of openings could be provided in the second housing to allow for additional positions, such as a third or fourth position. It should also be understood that the pins 831 and 832 could be bifurcated and possibly shortened so that one pin could pass through one set of openings. For example, a pin might pass through opening 811 and opening 821 while another pin would pass through the opening 812 and 822. The pins would be shorter. The pins could also be deployed by a mechanical mechanism or even an electrical system. For example, the pins could be repositioned using solenoids to disengage the pins from one set of openings while in a first position, and hold the pin until it can be deployed in a second set of openings in a second position. It should also be noted that the pins can be provided with various stops to limit the travel of the pins. In other words, the pins can be provided with a feature that makes the diameter of the pin larger than an opening into which it is to be placed. In this way, the pin will stop during insertion. Of course, the feature is placed to allow the pin to be inserted a sufficient distance to support the housings in their respective positions. It should be further pointed out that the pin concept can be extended to different embodiments of the storage system, such as when there are more than two housings. In FIG. 8, the openings in the bottom of the first housing 810 which do not carry reference numbers could be used to support the first housing and the second housing with respect to another housing.

Figure 4:
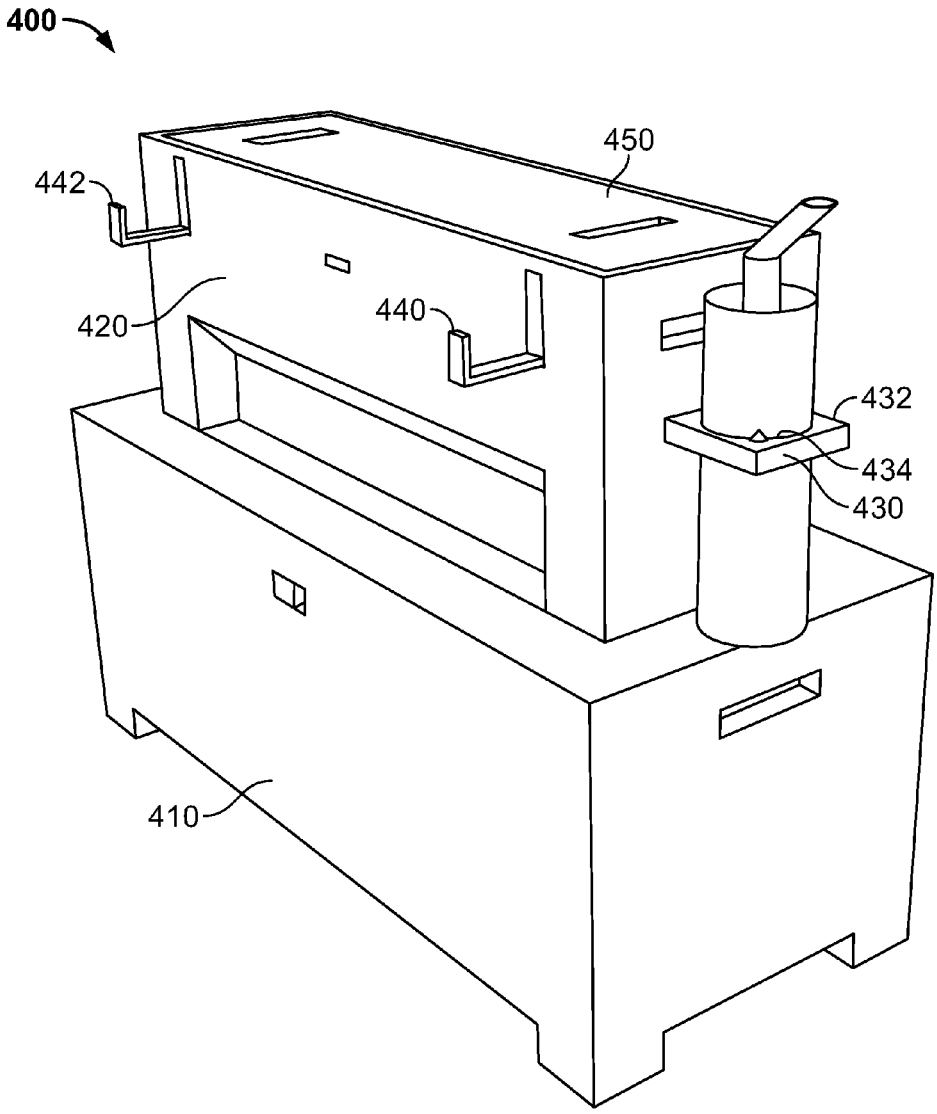
FIG. 4 is a perspective view of a multi-position storage system for use by a trade professional, according to an example embodiment.

FIG. 4 is a multi-position tool box and storage system 400 that is customized for use by a plumber or pipefitter, according to an example embodiment. The multi-position tool box and storage system 400 includes a first housing 410 and a second housing 420. The second housing 420 fits within the housing 410 when in a stowed position. The second housing 420 is moved with respect to the first housing 410 to an extended position. The multi-position tool box and storage system 400 is similar to the multi-position tool box and storage system 100 and therefore only the differences will be discussed in the following discussion. Among the differences are that the housing 420 includes a torch holder 430 that can be extended out from the side of the second housing 420. The torch holder 430 includes a substantially square shaped element 432 having an opening 434 therein with sufficient size to receive the cylindrical portion of a torch. The torch holder 430 slides out from the side of the housing 420. The torch holder 430 can be stowed in the housing 420 when not in use. The second housing also has a first pipe holding bracket or hook 440 and a second pipe holding bracket or hook 442. The pipe holding bracket or hooks 440, 442 fit within the housing 420 and specifically in a compartment under the lid 450 of the second housing 420. The pipe holding bracket or hook 440, 442 fit within corresponding openings in the housing 420. Before placing the housing 420 into a stowed position within the housing 410, the torch holder must be pushed into a stowed position and the brackets or hooks 440, 442 mush be placed within the compartment in the housing 420.

Figure 5:
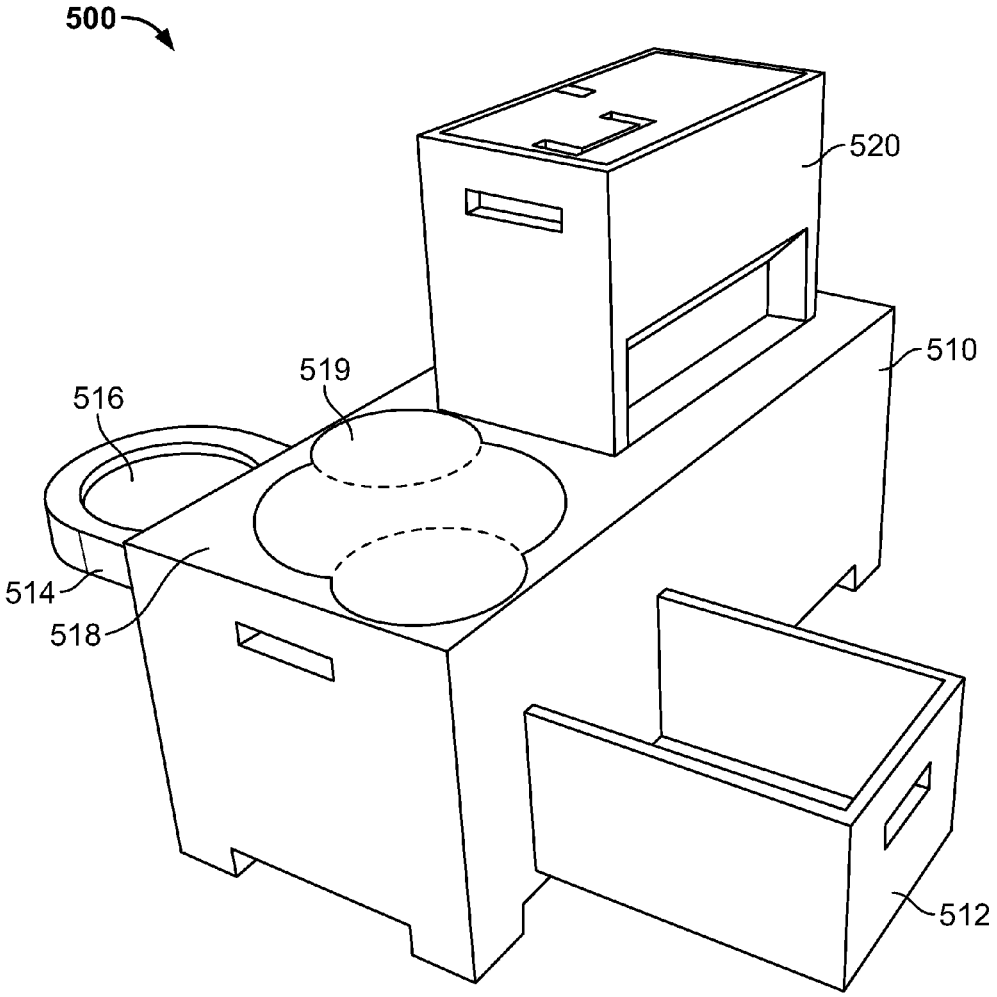
FIG. 5 is a perspective view of a multi-position storage system for use by another trade professional in a semi deployed position, according to an example embodiment.
Figure 6:
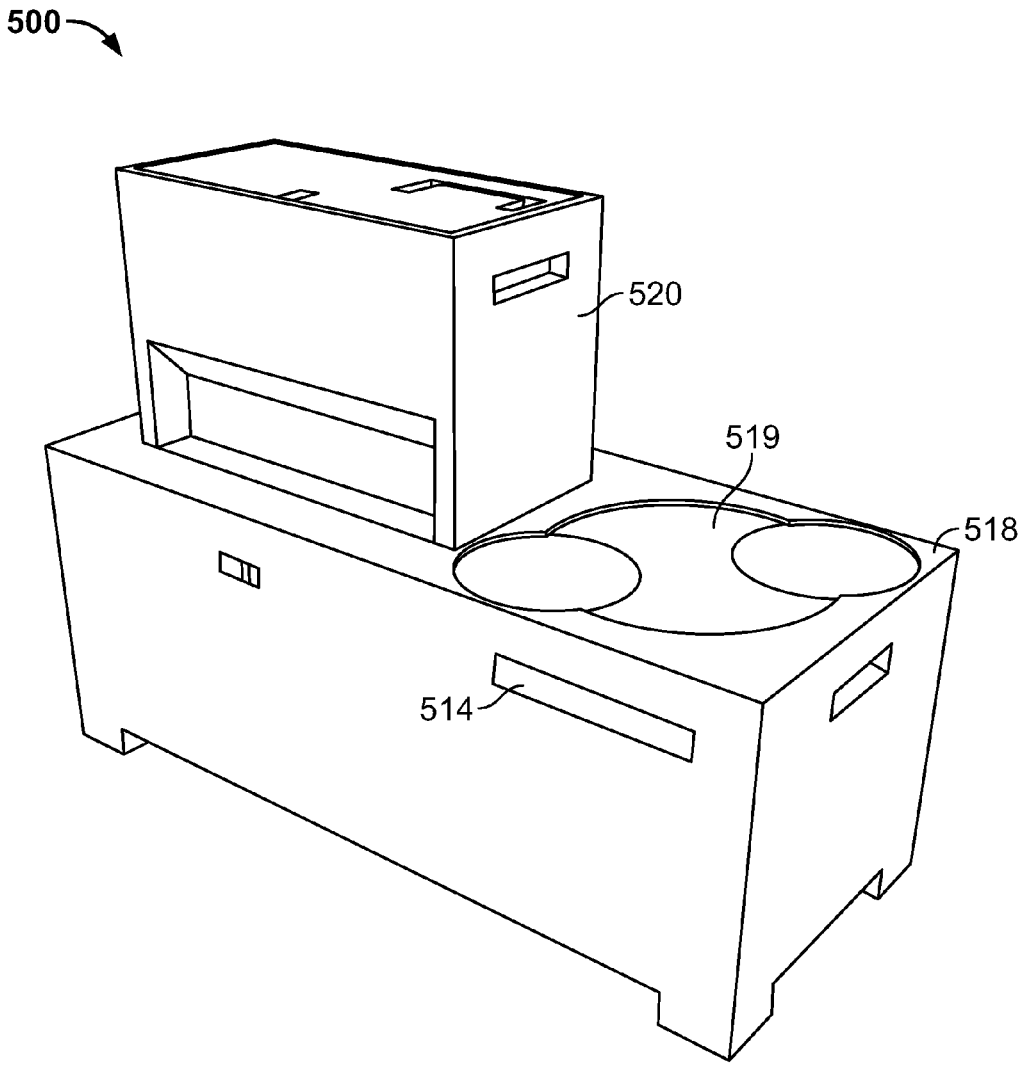
FIG. 6 shows the multi-position tool box and storage system of FIG. 5 in a fully deployed position, according to an example embodiment.

FIG. 5 is a multi-position tool box and storage system 500 that is customized for use by a painter, according to an example embodiment. FIG. 6 shows the multi-position tool box and storage system 500 of FIG. 5 in a fully deployed position, according to an example embodiment. As mentioned, the multi-position tool box and storage system 500 that is customized for use by a painter. The multi-position tool box and storage system 500 includes a first housing 510 and a second housing 520. The second housing 520 is stows within the first housing 510. The second housing 520 is considerably smaller than the housing 510. The second housing occupies about 40-45 percent of the volume of the first housing 510. The first housing 510 has a drawer 512 therein and a paint tray 514. Both the drawer 512 and the paint tray 514 extend outwardly from the housing 510. The drawer 512 is lower than the paint tray 514. The drawer 512 and the paint tray 514 occupy the half or roughly 60 percent of the volume of the first housing 510. The paint tray 514 includes an indentation 516 sized to receive a paint can or paint container. The indentation 516 prevents or inhibits a paint can from being knocked off the tray 514. The top surface 518 of the housing 510 also includes at least one similar indentation 519. In the embodiment shown, the top surface 518 includes multiple indentations. FIG. 6 shows the multi-position tool box and storage system 500 with the housing 520 extended with respect to the housing 510. The paint tray 512 and the drawer 514 are stowed within the first housing 510.

Figure 7:
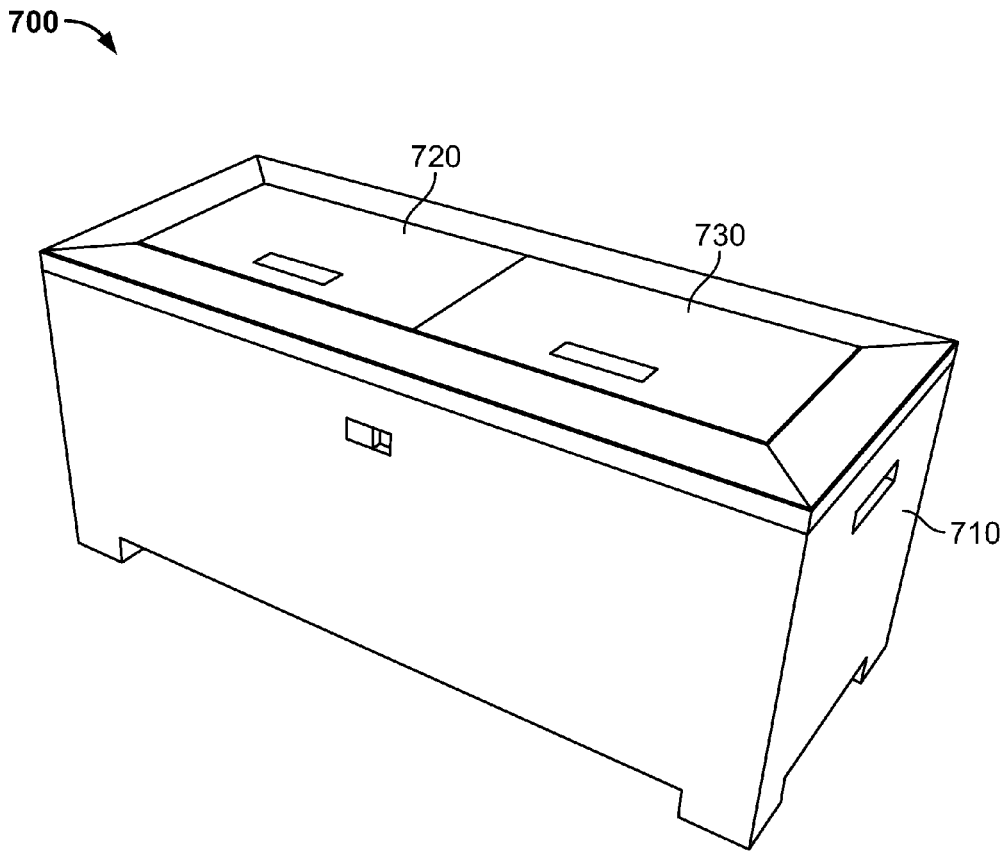
FIG. 7 a multi-position tool box and storage system for use as a cooler or a beverage dispenser, according to an example embodiment.

In still other embodiments, the multi-position tool box and storage box can be adapted for other specialized purposes. For example, as shown in FIG. 7 a multi-position tool box and storage system 700 is customized for use as a cooler or a beverage dispenser. The first housing 710 holds a second housing 720 and a third housing 730. Both the second housing 720 and the third housing 730 can be extended independently with respect to the first housing 710. As shown, the second housing 720 and the third housing 730 take up about equal volumes of space in the first housing 710. It should be pointed out that the second housing 720 can take up any amount of space of the first housing. The third housing 30 can also take up any amount of space with respect to the first housing 710. The second housing 720 is beside the third housing 730. The compartments can be provided with various features. For example, one or both of the second housing 720 and the third housing 730 can be provided with insulated walls and tops so as to form a cooler in one or both of the housings 720, 730.

Other embodiments of the multi-position tool box or storage box are also contemplated. Various combinations of the designs shown above may be combined. Wheels can be added to the first housing, such as housing 110, 710 to make the resulting multi-position storage unit and tool box easier to transport. In one embodiment, a chair is provided with a multi-position storage or tool box. The multi-position storage and tool box, such as 100, 300 and 700, can also be made in different sizes. The various embodiments can be scaled up or scaled down as desired.

The main idea behind the multi-position storage and tool box, such as 100, 300 and 700, is to be able to reach a little higher than an average step-stool. For example, with a regular step stool, changing a light bulb can be a chore and dangerous because the light bulb is at a distance that one can hardly reach. With this multi-position storage and tool box, such as 100, 300 and 700, one can raise the center of the box, step up on it and be able to reach approximately 10 inches higher than what the average step stool. When not extended, multi-position storage and tool box, such as 100, 300 and 700, looks like an average tool box or step stool. The multi-position storage and tool box, such as 100, 300 and 700, can easily be extended and used to reach places that were previously unreachable. The multi-position storage and tool box, such as 100, 300 and 700, is not bulky like a ladder and has multiple purposes. It serves as storage for personal items or tools, and also serves as a step stool or a small ladder. The multi-position storage and tool box, such as 100, 300 and 700, is unique because it provides just enough "step-up" to reach those places where a single step step-stool would not allow a person to reach. In some instances, the multi-position storage and tool box, such as 100, 300 and 700, allows the user to get into tight spots where a ladder would not fit.

This has been a detailed description of some exemplary embodiments of the invention(s) contained within the disclosed subject matter. Such invention(s) may be referred to, individually and/or collectively, herein by the term "invention" merely for convenience and without intending to limit the scope of this application to any single invention or inventive concept if more than one is in fact disclosed. The detailed description refers to the accompanying drawings that form a part hereof and which shows by way of illustration, but not of limitation, some specific embodiments of the invention, including a preferred embodiment. These embodiments are described in sufficient detail to enable those of ordinary skill in the art to understand and implement the inventive subject matter. Other embodiments may be utilized and changes may be made without departing from the scope of the inventive subject matter. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed:

1. A multi-position tool box comprising:

a first housing;

a second housing connected to the first housing, the second housing capable of being moved from a first position with respect to the first housing to a second position with respect to the first housing, the second housing moving between the first position and the second position and having a portion of the second housing within the first housing while being moved from the first position to the second position, a second plane defined by a side of the second housing remaining substantially parallel to a first plane defined by a side of the first housing near the side of the second housing, the movement of the second housing remaining parallel to a line associated with the first housing; and a locking mechanism for locking the position of the first housing with respect to the second housing, wherein the second housing includes a holder slidable from a side of the second housing end and can be stowed in the housing when not in use.

2. The multi-position tool box of claim 1 wherein at least one of the first housing and the second housing has storage compartments therein, the storage compartments sized to receive tools.

3. The multi-position tool box of claim 1 wherein at least one of the first housing and the second housing is sized to serve as a step.

4. The multi-position tool box of claim 3 wherein at least one of the first housing and the second housing that is sized to serve as a step is structurally able to support the load of a human.

5. The multi-position tool box of claim 1 wherein both the first housing and the second housing is sized to serve as a step.

6. The multi-position tool box of claim 5 wherein the first housing and the second housing can support a human.

7. The multi-position tool box of claim 1 further comprising a third housing that is connected to the second housing, the third housing capable of being moved from a first position with respect to the second housing to a second position with respect to the second housing.

8. The multi-position tool box of claim 7 further comprising a second locking mechanism for locking the position of the second housing with respect to the third housing.

9. The multi-position tool box of claim 1 further comprising a movable shelf positioned within the first housing.

10. The multi-position tool box of claim 9 wherein the movable shelf includes an indentation.

11. The multi-position tool box of claim 9 wherein the movable shelf includes an indentation sized to receive a paint can.

12. The multi-position tool box of claim 1 wherein the first housing includes a surface having at least one indentation therein.

13. The multi-position tool box of claim 1 wherein at least one of the first housing and the second housing has an insulated storage compartment therein.

14. The multi-position tool box of claim 1 wherein at least one of the first housing and the second housing includes a set of handholds.

15. The multi-position tool box of claim 1 wherein at least one of the first housing and the second housing has legs which hold the storage container off the ground.

16. The multi-position tool box of claim 1 further comprising:

a first hook; and a second hook, the first hook and the second hook attachable to a side of the second housing.

17. The multi-position tool box of claim 1 wherein the locking mechanism includes at least a first pin and a second pin sized to hold the second housing with respect to the second housing, the pins sized to bear the load of a human being.

* * * * *